US009527186B2

(12) United States Patent
Tanaka et al.

(10) Patent No.: US 9,527,186 B2
(45) Date of Patent: Dec. 27, 2016

(54) EYEGLASS LENS PROCESSING SYSTEM AND EYEGLASS LENS PROCESSING METHOD

(71) Applicant: NIDEK CO., LTD., Aichi (JP)

(72) Inventors: Motoshi Tanaka, Gamagori (JP); Hirokatsu Obayashi, Toyokawa (JP)

(73) Assignee: NIDEK CO., LTD., Aichi (JP)

( * ) Notice: Subject to any disclaimer, the term of this patent is extended or adjusted under 35 U.S.C. 154(b) by 261 days.

(21) Appl. No.: 14/175,050

(22) Filed: Feb. 7, 2014

(65) Prior Publication Data

US 2014/0228995 A1 Aug. 14, 2014

(30) Foreign Application Priority Data

Feb. 9, 2013 (JP) ..... 2013-023917

(51) Int. Cl.

| | |
|---|---|
| ***A61B 3/10*** | (2006.01) |
| ***A61B 3/00*** | (2006.01) |
| ***B24B 27/00*** | (2006.01) |
| ***B24B 9/14*** | (2006.01) |

(52) U.S. Cl.

CPC ..... *B24B 27/0023* (2013.01); *B24B 9/148* (2013.01)

(58) Field of Classification Search

USPC ..... 351/200–246, 158, 159

See application file for complete search history.

(56) References Cited

U.S. PATENT DOCUMENTS

| | | | | |
|---|---|---|---|---|
| 6,104,828 | A * | 8/2000 | Shioiri | A61B 3/0058 351/206 |
| 8,588,479 | B2 * | 11/2013 | Su | A61B 5/117 348/78 |
| 9,033,507 | B2 * | 5/2015 | Alasaarela | A61B 3/12 351/221 |
| 2014/0340638 | A1 * | 11/2014 | Imamura | A61B 3/1025 351/206 |
| 2015/0297077 | A1 * | 10/2015 | Shimozato | A61B 3/14 351/206 |

FOREIGN PATENT DOCUMENTS

JP 11019857 A 1/1999

* cited by examiner

*Primary Examiner* — Mohammed Hasan

(74) *Attorney, Agent, or Firm* — Sughrue Mion, PLLC

(57) ABSTRACT

An eyeglass lens processing system includes: a plurality of processing devices including first and second processing devices, each of the first and second processing devices including a lens processing unit configured to process an eyeglass lens and a processing control unit configured to control the lens processing unit; a memory unit configured to store first processing information based on which the first processing device performs a first process on the eyeglass lens; and a processing setting unit that includes a setting unit configured to set, for each of the first and second processing devices, correction data based on which the first processing information is to be corrected to acquire second processing information. One of the first and second processing devices performs a second process on the eyeglass lens based on the second processing information.

19 Claims, 9 Drawing Sheets

EYEGLASS LENS PROCESSING SYSTEM AND EYEGLASS LENS PROCESSING METHOD

CROSS REFERENCE TO RELATED APPLICATION

This application is based upon and claims the benefit of priority of Japanese Patent Application No. 2013-023917 filed on Feb. 9, 2013, the contents of which are incorporated herein by reference in its entirety.

BACKGROUND

The present invention relates to an eyeglass lens processing system and an eyeglass lens processing method for processing an eyeglass lens.

An eyeglass lens processing device is known that obtains processing information from shape measurement data, layout data and the like for an eyeglass frame, and, automatically grinds a periphery of an eyeglass lens based on the processing information up to a lens bevel processing. See for example JP-A-11-019857.

SUMMARY

There is a case where when the eyeglass lens processed by the processing device is assembled into the frame, the shape of the frame does not agree with the shape of the lens and cannot be assembled together. In this case, it is necessary to re-process (re-grind) the eyeglass lens.

However, in the related art, when the eyeglass lens is corrected by the re-grinding after the processing is once completed, it is necessary for a person to determine which part needs to be re-grinded, and to input corrected processing data into the processing device. In the method of the related art, it is always necessary for a person to attend on the processing device and thus, the productivity is not good.

When a special processing is performed, there is a case where after simulation is performed based on a result measured by a lens measurement unit that is provided in the processing device, processing data is corrected for the processing device. Even in both the case, it is always necessary for a person to attend on the processing device and thus, the productivity is not good.

One aspect of the present invention is made in light of the related art, and an object of one aspect of the present invention is to provide an eyeglass lens processing system, and an eyeglass lens processing method by which an eyeglass lens can be efficiently processed.

One aspect of the present invention provides the following arrangements:

An eyeglass lens processing system comprising:

a plurality of processing devices including first and second processing devices, each of the first and second processing devices including a lens processing unit configured to process an eyeglass lens and a processing control unit configured to control the lens processing unit;

a memory unit configured to store first processing information based on which the first processing device performs a first process on the eyeglass lens; and a processing setting unit that includes a setting unit configured to set, for each of the first and second processing devices, correction data based on which the first processing information is to be corrected to acquire second processing information, wherein one of the first and second processing devices performs a second process on the eyeglass lens based on the second processing information.

An eyeglass lens processing method for controlling an eyeglass lens processing system including a plurality of processing devices, the method comprising:

performing a first processing on the eyeglass lens using one of the plurality of processing devices based on first processing information;

setting, for each of the plurality of processing devices, correction data based on which the first processing information which is stored in a memory is to be corrected to acquire second processing information;

acquiring the second processing information; and performing the second processing on the eyeglass lens using any one of the plurality of processing devices based on the second processing information.

An eyeglass lens processing system comprising:

a plurality of processing devices, each of which is configured to process a plurality of eyeglass lenses based on first processing information and second processing information;

a host computer configured to store the first processing information which is selectively transmitted to one of the plurality of processing devices, and is used in a first processing in which a non-processed eyeglass lens is processed;

an external terminal that is remotely disposed from the processing device and the host computer, and is configured to access to the first processing information, the external terminal being configured to receive the first processing information and set correction data for performing a second processing in which the eyeglass lens which is processed based on he first processing information is further processed, and wherein the first processing information is corrected based on the correction data set by the external terminal, and wherein the one of the plurality of processing devices which has processed the eyeglass lens based on the first processing information processes the eyeglass lens based on the second processing information.

According to the present invention, it is possible to efficiently process the eyeglass lens.

DESCRIPTION OF EXEMPLARY EMBODIMENTS

Figure 1:
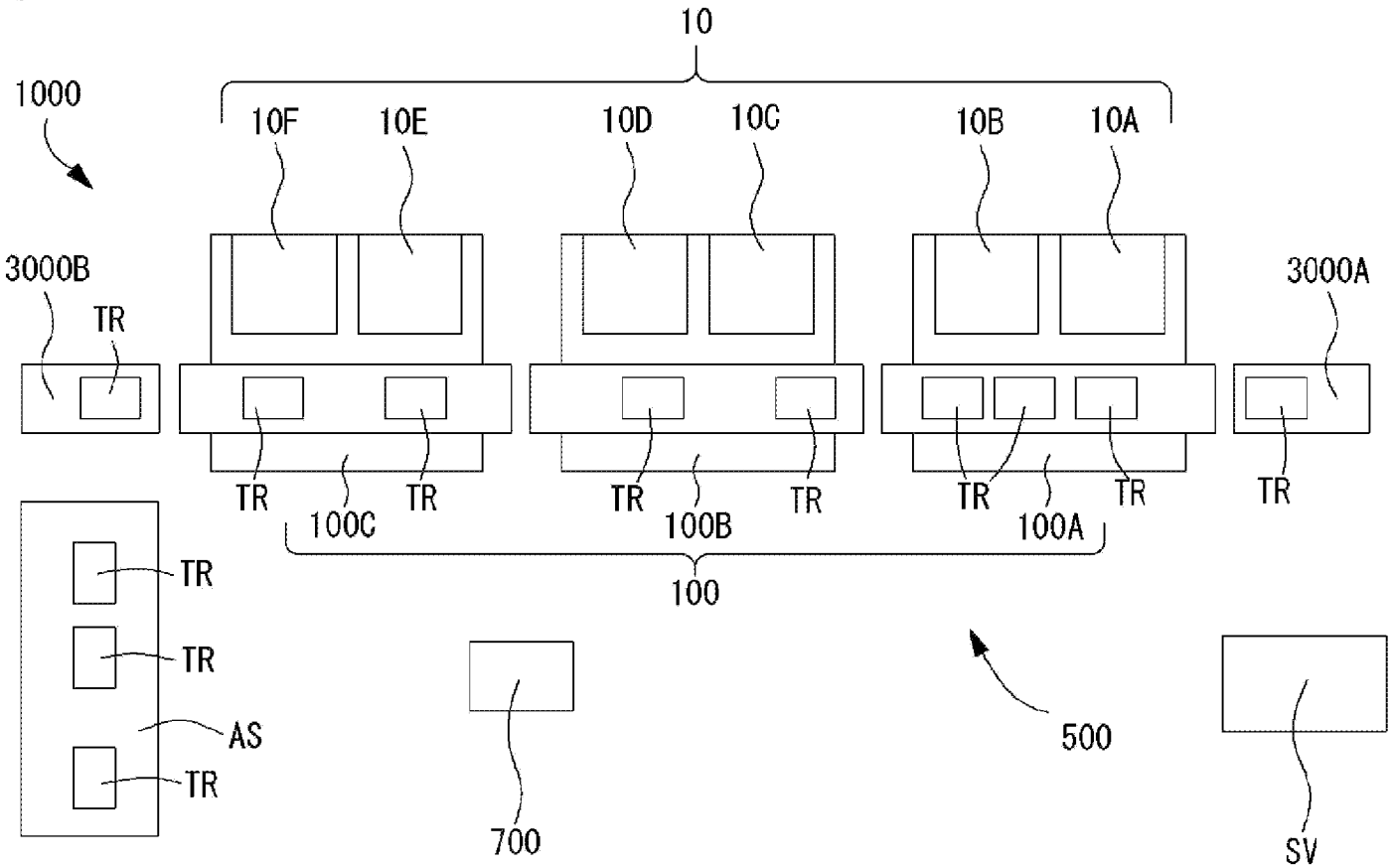
FIG. 1 is an overall schematic view of an eyeglasses manufacturing system according to the present invention.

An embodiment according to the present invention will be described.

<Outline>

An eyeglass lens processing system 1000 includes a plurality of eyeglass lens processing devices (hereinafter, processing devices) 10. The processing device 10 has a lens processing unit (for example, a lens processing unit 12), and is used to process an eyeglass lens based on processing information on the eyeglass lens.

A processing setting unit (for example, a terminal 700) includes a setting unit that can set correction data for each of the processing devices to acquire second processing information obtained by correcting first processing information which is stored in a processing information memory unit and can be used by the processing device 10.

Furthermore, the processing setting unit (for example, the terminal 700) has an acquisition unit that can acquire the first processing information for each of the processing devices. For example, a control unit 750 of the terminal 700 is used as the acquisition unit and the setting unit. The acquisition unit acquires the first processing information from a processing information memory unit (for example, a server SV) that stores the first processing information which can be used by the processing device 10. Accordingly, for example, it is possible to arbitrarily change the first processing information.

Even though the processing setting unit is configured not to have the acquisition unit that acquires the first processing information, the configuration is acceptable as long as the correction data can be set for each of the processing units. For example, the correction data is set on the processing setting unit. Each of the processing devices may be configured to correct the first processing information based on the correction data, and to use the second processing information. That is, for example, when the terminal 700 is provided with the processing setting unit, a processing operator disposes the processing setting unit at a convenient position and thus, the workability improves. A disposition location of the processing setting unit is not particularly limited, and the processing device 10 may be provided with the processing setting unit, or the server SV may be provided with the processing setting unit.

The processing system 1000 can perform a first processing on the eyeglass lens using any one of the plurality of processing devices 10 based on the first processing information. The second processing information is acquired by correcting the first processing information with the set correction data. The processing system 1000 can perform a second processing on the eyeglass lens using any one of a plurality of the processing devices based on the second processing information.

For example, when the correction data is set, the second processing information into which the first processing information is corrected is acquired in the processing setting unit. The present invention is not limited to the configuration, and the second processing information may be used in the processing device using the correction data set through the processing setting unit.

A configuration of the second processing information being acquired is not particularly limited. For example, the second processing information may be acquired in an individual control unit 50 provided in each of the processing devices 10. The second processing information may be acquired in the server SV, and may be acquired by the control unit 750 of the terminal 700.

<Processing the Same Eyeglass Lens Multiple Times>

For example, the processing system 1000 is used to process the same eyeglass lens multiple times. The first processing information is acquired and used for a non-processed eyeglass lens. The correction data is set to obtain the second processing information that is used for a processed eyeglass lens as the correction data. The processing system 1000 performs the first processing on the non-processed eyeglass lens using any one of the plurality of processing devices 10 based on the first processing information. The second processing information is acquired by correcting the first processing information with the set correction data. The processing system 1000 can perform the second processing on the processed eyeglass lens using any one of the plurality of processing devices 10 based on the second processing information.

<Processing Information Memory Unit>

For example, each of the processing devices 10 is set to sequentially process a right and a left eyeglass lenses for an eyeglass frame.

The processing system 1000 includes the processing information memory unit that stores the first processing information which can be used by the plurality of processing devices 10. A location of the memory unit is not particularly limited. In addition to the server SV, the processing information memory unit may be any one of the followings: a memory 755 of the terminal 700; a memory 14 of each of the processing devices; and another external memory.

For example, the processing information memory unit stores the first processing information for the eyeglass frame which is already used by each of the processing devices 10 even after the processing device 10 moves to a step in which a right and a left eyeglass lenses for a next eyeglass frame are processed. For example, the memory unit may have the following specific configuration: a hard disk drive, a flash ROM, a flash memory or the like.

<Processing by the Same Device>

For example, in the processing system 1000, the second processing information is acquired by the processing device 10 that performs the first processing using the first processing information which corresponds to the second processing information. The processing system 1000 performs the second processing on the same eyeglass lens using the same processing device 10 that performs the first processing based on the second processing information. Accordingly, for example, when the same eyeglass lens is processed multiples times in the system equipped with the plurality of processing devices 10, it is possible to improve precision.

<Processing Condition Change Before Processing is Performed>

For example, the processing system 1000 is used to change processing conditions before a processing is performed. For example, the first processing information is acquired before the first processing is performed by the processing device. The correction data is set before the first processing is performed by the processing device 10. Instead of performing the first processing on a non-processed eyeglass lens, the processing system 1000 can perform the second processing on the non-processed eyeglass lens using any one of the plurality of processing devices 10 based on the second processing information.

<Guide Mode>

For example, the processing system 1000 can execute the following guide mode. For example, each of the processing devices 10 has a measurement unit (for example, a lens shape measurement unit 13) that measures the shape of a non-processed eyeglass lens.

Furthermore, the processing system 1000 acquires identification information from an identification information memory unit, and the identification information is to identify whether the processing system 1000 commands the processing device 10 to execute the guide mode. The identification information memory unit stores identification information for identifying whether the processing system 1000 commands the processing device 10 to execute the guide mode. A memory location is not particularly limited. For example, in addition to the server SV, the identification information memory unit may be any one of the followings: the memory 755 of the terminal 700; the memory 14 of each of the processing devices; and another external memory.

For example, the processing system 1000 has a guide control unit. When the identification information through which the guide mode is executed is acquired, the guide control unit temporarily stops the processing unit (for example, the lens processing unit 12) after a measurement is performed by the measurement unit. For example, an individual control unit 50 is used as the guide control unit, but the present invention is not particularly limited to the individual control unit 50. The control unit 750 of the terminal 700 may be used as the guide control unit.

The processing setting unit has a display control unit that simulates the shape of a processed lens based on the shape of the vicinity of an edge measured by the lens shape measurement unit and the first processing information, and graphically displays a simulation result on a display unit. For example, when the control unit 750 of the terminal 700 is used as the display control unit, a processing operator may dispose the control unit 750 at a convenient position and thus, workability improves. However, the present invention is not limited to the configuration. For example, when the processing device 10 is provided with a monitor, the individual control unit 50 may be used as the display control unit.

Herein, after the simulation result is displayed on the display unit, the correction data is set. It is possible to process the eyeglass lens by controlling the processing unit in a temporary stop based on the second processing information.

<Processing Control Unit>

For example, each of the processing devices 10 has a processing control unit (for example, the individual control unit 50) that controls the processing unit (for example, the lens processing unit 12) based on processing information on the eyeglass lens.

The processing control unit obtains the second processing information from the set correction data. The processing control unit controls the lens processing unit (for example, the lens processing unit 12) to perform the second processing on the eyeglass lens based on the second processing information.

The embodiment is not limited to the configuration in which each of the processing devices 10 is provided with the processing control unit. For example, one processing control unit may be configured to control the plurality of processing devices 10. The control unit 750 of the terminal 700 may be configured to control the plurality of processing devices 10.

<Selection of First Processing Information>

For example, the processing setting unit includes an instruction reception unit that receives an instruction from an operator. The processing setting unit includes a selection process unit that, based on an instruction received by the instruction reception unit, selects the first processing information for at least one eyeglass lens from a plurality of items of the first processing information stored in the processing information memory unit. For example, the control unit 750 of the terminal 700 is used as the instruction reception unit and the selection process unit, but the present invention is not limited to the configuration. For example, the instruction reception unit receives an instruction from an operator through a user interface such as a touch panel.

In the processing setting unit, the correction data is set to acquire the second processing information into which the selected first processing information is corrected.

<Processing Device>

The processing device 10 provided in the processing system 1000 of the embodiment will be described. For example, the processing device 10 acquires the first processing information from the processing information memory unit that stores the first processing information. The processing control unit (for example, the individual control unit 50) of the processing device 10 can drive the lens processing unit (for example, the lens processing unit 12) to perform the first processing on the eyeglass lens based on the first processing information.

The processing control unit acquires the second processing information by correcting the first processing information with the set correction data. The processing control unit can drive the lens processing unit to perform second processing on the eyeglass lens based on the second processing information.

<Processing Device Control Program>

For example, a processing device control program is stored in the memory (non volatile memory) 14 of the processing device 10. The processing device control program is executed by a processor (for example, the individual control unit 50) of the processing device 10.

For example, the processing device control program can cause the processing device 10 to execute a first acquisition step, a first control step, a second acquisition step and a second control step. The sequence of the steps is not particularly limited.

In the first acquisition step, the first processing information is acquired from the processing memory unit that stores the first processing information. In the first control step, the lens processing unit can be driven to perform the first processing on the eyeglass lens based on the first processing information acquired in the first acquisition step.

In the second acquisition step, the second processing information is acquired by correcting the first processing information with the set correction data. In the second control step, the lens processing unit can be driven to perform the second processing on the eyeglass lens based on the second processing information acquired in the second acquisition step.

<Terminal>

An external terminal device (for example, the terminal 700) used in the processing system 1000 is provided to be accessible to the plurality of processing devices 10. For example, the external terminal device is connected to the processing device 10 in such a manner that the external terminal device and the processing device 10 can communicate with each other in a wired or a wireless system.

<Eyeglass Lens Processing Program>

For example, an eyeglass lens processing program is stored in the memory 755 of an external terminal (for example, the terminal 700). The eyeglass lens processing program is executed by a processor (for example, a control unit 750) of the external terminal.

For example, a first processing step, a setting step, an acquisition step, and a second processing step are executed. The sequence of the steps is not particularly limited.

In the first processing step, any one of the plurality of processing devices 10 performs the first processing on the eyeglass lens based on the first processing information. In the setting step, the correction data is set using the processing setting unit. In the acquisition step, the second processing information is acquired by correcting the first processing information with the set correction data. In the second processing step, any one of the plurality of processing devices performs the second processing on the eyeglass lens based on the second processing information.

<Instruction from Operator>

For example, the processing setting unit includes the instruction reception unit that receives an instruction from an operator. The processing setting unit sets the correction data based on the instruction received by the instruction reception unit. For example, the control unit 750 of the terminal 700 is used as the instruction reception unit, but the present invention is not limited to the configuration. For example, the instruction reception unit receives an instruction from an operator through a user interface such as a touch panel.

<Processing Device Memory Unit>

For example, the processing device memory unit is used in the processing system 1000. The processing device memory unit stores processing device information that indicates which one of the processing devices 10 processes the eyeglass lens. In this case, for example, identification information for identifying each of the eyeglass lenses corresponds to identification information for identifying each of the processing devices (details will be described later).

<Display Control Unit>

The processing setting unit may include the display control unit (for example, the control unit 750) that displays the processing device information on the display unit (for example, the display unit 710), and the processing device information indicates which one of the processing devices 10 processes the eyeglass lens.

The processing setting unit may include the display control unit that displays the fact that the processing unit temporarily stops on the display unit. Herein, when only one of the processing units temporarily stops, the display control unit automatically displays a simulation result on the display unit. When a plurality of the processing units temporarily stop, the display control unit may sequentially display simulation results.

<Detail of Configuration>

Figure 2:
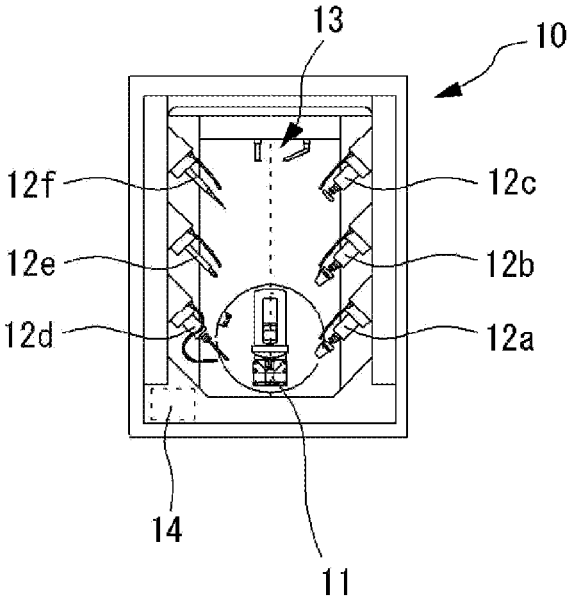
FIG. 2 is a view illustrating an internal structure of a processing device.
Figure 3:
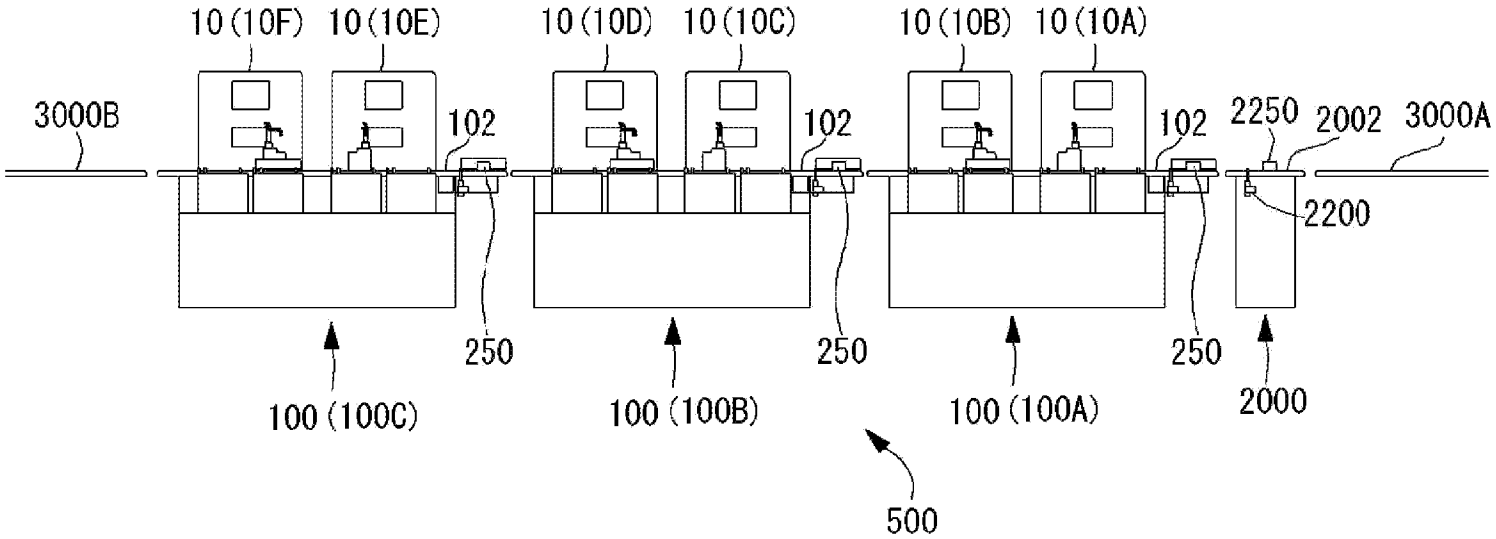
FIG. 3 is a schematic front view of the processing device and a transportation robot.

Hereinafter, an example of the eyeglass lens processing system according to the embodiment will be described. FIG. 1 is a view illustrating a schematic configuration of the eyeglass lens processing system according to the embodiment. The eyeglass lens processing system 1000 of the embodiment is configured to have the processing device 10, a transportation robot 500 that transports a lens LE, the terminal 700 equipped with an input unit, the server SV that manages data for the lens, and the like. The present invention is not limited to the configuration. FIG. 2 is a schematic view illustrating an internal structure of the processing device 10. FIG. 3 is a schematic view when the transportation robot is seen from the front.

<Processing Device>

For example, the processing device 10 is a device that processes the periphery of an eyeglass lens. The eyeglass lens processing system 1000 of the embodiment may be provided with the plurality of processing devices 10. The processing device 10 includes a lens chuck shaft 11 that retains the eyeglass lens LE; the lens processing unit 12 that has a processing tool for processing the periphery of the lens LE; the lens shape measurement unit 13 that measures the shapes (at positions of edges that correspond to the lens shape) of the front and the back surfaces of the lens; the memory 14 that stores data such as the processing information; and the like (refer to FIG. 2). The processing tool includes a bevel processing tool (processing tool for forming a bevel in the periphery of the lens) and the like. The memory 14 may be a memory medium (for example, a flash memory or the like) that can be removably inserted. The processing device 10 may control a relative movement between the lens LE and the lens processing unit 12 to process the periphery of the lens LE based on the processing information such as the lens shape which is input. The lens processing unit 12 of the embodiment includes a plurality of lens processing tools 12*a* to 12*f*. The lens chuck shaft 11 of the embodiment can be moved and rotated by a drive mechanism that is not illustrated. Accordingly, the processing tools 12*a* to 12*f* used in the processing can be switched with each other. The lens LE is disposed at a measurement point of the measurement unit 13 by moving and rotating the lens chuck shaft 11. Since the processing device 10 has well known configurations disclosed in JP-A-2004-34167 and the like, a description thereof will be omitted. The processing device 10 may be configured to perform a processing with water being supplied or without water being supplied.

<Transportation Robot>

For example, the transportation robot 500 may include a plurality of remote conveyer line units (hereinafter, RCL units) 100 that has at least one belt type conveyer line 102 to transport a tray TR containing the lens LE to the device. Each of the RCL units has a base, and at least one processing device 10 is disposed on the base to correspond to the conveyer line 102. The transportation of the transportation robot 500 is preferably performed in a configuration of a container that can contain the eyeglass lens LE. For example, the transportation may be performed in a configuration of a fixture to which the eyeglass lens LE can be fixed. The configuration of the transportation robot 500 is not limited to the configuration of the embodiment. The transportation robot 500 may have a configuration disclosed in JP-A-2000-94283 or JP-A 2012-183633.

In FIG. 1, the transportation robot 500 includes three RCL units 100 (hereinafter, reference numerals 100A, 100B and 100C are used to distinguish three RCL units from each other). Each of the RCL units 100 may be connected to each other in series. The tray TR is transported from the conveyer line 102 of the upstream RCL unit 100A to the conveyer line 102 of the downstream RCL unit 100C.

A carry-in conveyer line 3000A may be disposed upstream of the RCL unit 100A to carry in the tray TR that contains the non-processed lens LE. A perform conveyer line 3000B may be disposed downstream of the RCL unit 100C to perform the tray TR that contains the processed lens LE. A distribution unit 2000 having a conveyer line 2002 may be provided between the RCL unit 100A and the carry-in conveyer line 3000A. The distribution unit 2000 functions as a tray supply unit that supplies the tray TR to the conveyer line 102 of the most-upstream RCL unit 100A, and the distribution unit 2000 may include a stopper unit 2200 that stops movement of the tray TR which is carried in from the upstream carry-in conveyer line 3000A; a main identifier reader 2250 (for example, a bar code reader); and a main control unit 2050 (refer to FIG. 6). The distribution unit 2000 may be provided in the most-upstream RCL unit 100A.

Figure 4:
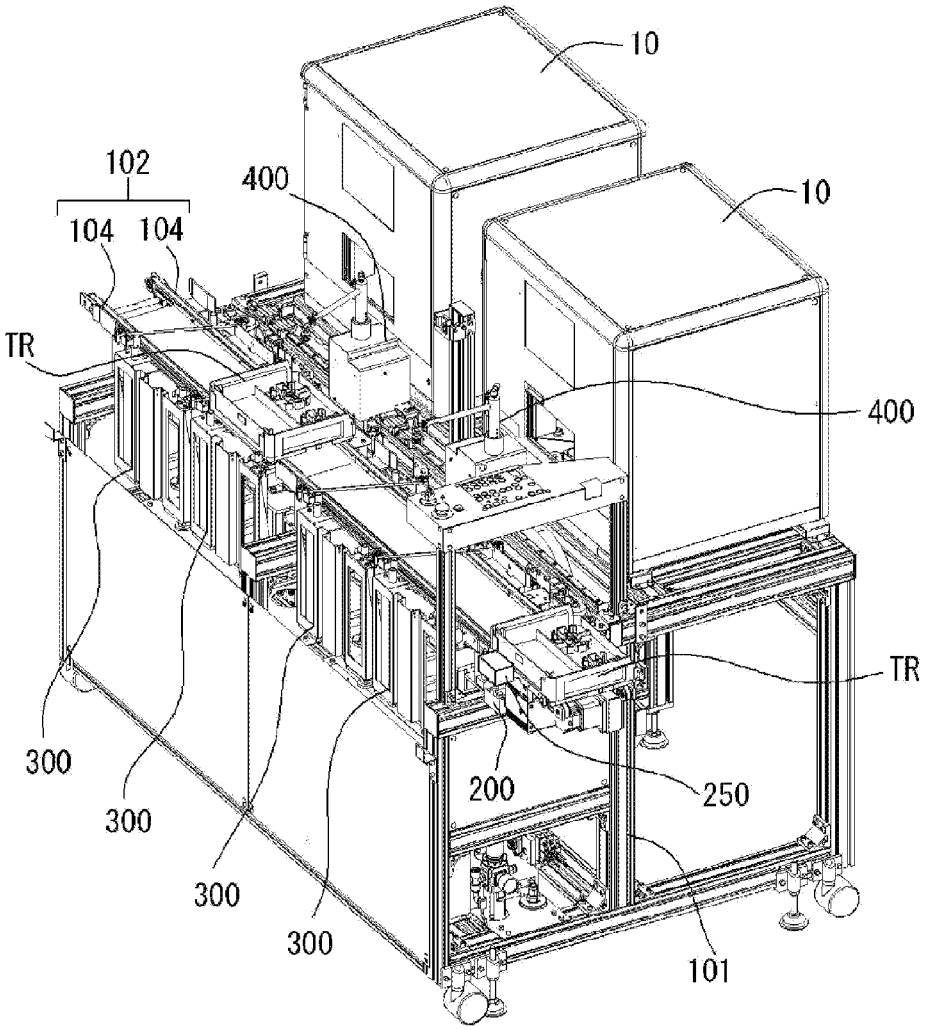
FIG. 4 is an exterior perspective view of an individual conveyer line unit 100.
Figure 5:
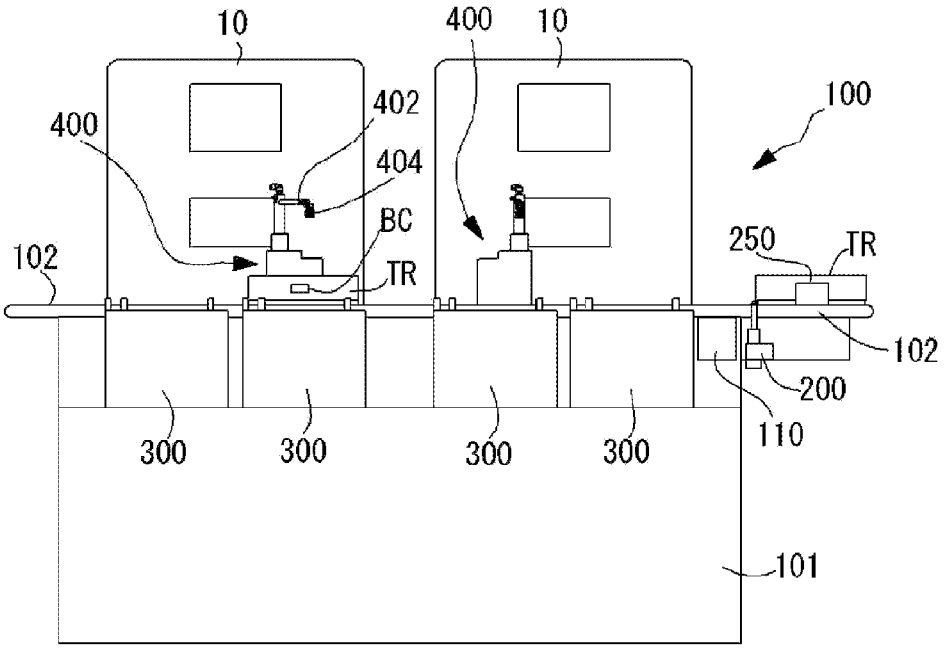
FIG. 5 is a schematic front view of the individual conveyer line unit 100.

FIG. 4 is an exterior perspective view describing a configuration of the RCL unit 100. FIG. 5 is a schematic front view of the RCL unit 100.

The conveyer line 102 has two belts 104, and two belts 104 are simultaneously transported by a drive unit 110. In addition to the belt-type configuration of the embodiment, the conveyer line 102 may have various types of configurations such as a roller-type configuration. The conveyer line 102 is disposed on a base 101. The tray TR mounted on the belts 104 is transported from a right side to a left side in FIG. 3. A stopper unit 200 and the identifier reader (bar code reader) 250 are disposed upstream (on a right side in FIG. 3) of the conveyer line 102, and the stopper unit 200 stops movement of the tray TR on the belts 104 and the identifier reader 250 reads a bar code BC which is an identifier affixed to the tray TR. When the stopper unit 200 stops the transportation of the tray TR, the bar code BC is read by the individual identifier reader 250. The identifier may be affixed to each lens. The identifier is not limited to the bar code, and a radio frequency identification (RFID) tag, an IC tag or the like may be used as the identifier.

In FIGS. 4 and 5, a tray elevation unit 300 is disposed to correspond to the processing device 10, and the tray elevation unit 300 functions as a tray movement unit that moves the tray TR from the conveyer line 102, and mounts the tray TR containing the processed lens LE on the conveyer line 102 again. The tray elevation unit 300 separates the tray TR from the conveyer line 102 and moves the tray TR to a predetermined waiting position that is provided with respect to each of the processing devices 10 to wait for a processing of the lens. In this example, two tray elevation units 300 are disposed to correspond to one processing device 10. In FIG. 5, since two processing devices 10 are disposed with respect to the RCL unit 100, four tray elevation units 300 are disposed with respect to the RCL unit 100. The tray elevation unit 300 moves the tray TR upward to a predetermined waiting position higher than a height at which the tray TR is transported by the belts 104. Accordingly, the RCL unit 100 can pass the tray TR transported by the belts 104. A detailed configuration of the tray elevation unit 300 is described in JP-A-2012-183633.

In FIGS. 4 and 5, a robot 400 is disposed as a lens movement unit between the processing device 10 and the conveyer line 102. The robot 400 unloads the lens LE from the tray TR to move the lens LE to the processing device 10, and unloads the lens LE processed by the processing device 10 from the processing device 10 to move the processed lens LE to the tray TR again. The robot 400 has the same configuration as that of a robot hand unit disclosed in JP-A-2004-34167. The robot 400 moves in a right and left direction of FIG. 5 along a rail that extends in parallel to the belt 104. The robot 400 has an arm 402 that moves upward and downward and rotates, and a suction unit 404 is attached to a tip end of the arm 402 to suck in the lens LE. The suction unit 404 retains the lens LE on the tray TR and the robot 400 moves the lens LE to the lens chuck shaft 11 of the processing device 10.

The RCL unit 100 is preferably provided with at least one robot 400. In FIGS. 4 and 5 of the embodiment, two robots 400 are disposed in the RCL unit 100. Two robots 400 efficiently move the lens LE between the tray TR and the processing device 10.

<Terminal>

The eyeglass lens processing system 1000 includes the terminal 700. The terminal 700 is a computer that includes an input unit such as a key board, a mouse and a touch panel; display unit; and the like. The terminal 700 may be a stationary type computer or a portable tablet computer. The terminal 700 of the embodiment is a tablet computer that includes a display unit 710, the control unit 750, the memory 755 and the like (refer to FIG. 6). The control unit 750 of the terminal 700 is connected to the other control units (the individual control unit 50, the main control unit 2050 and the like) to be described later, the memory 14 of the processing device 10 and the like in a wired or a wireless system.

<Server>

For example, the server SV is a host computer that stores processing setting data for the lens LE, which corresponds to a work number, and the like in a memory. The server SV is connected to the processing device 10 and the like. The server SV may be configured to integrate with the processing device 10 or the terminal 700. That is, the processing device 10 or the terminal 700 may function as the server SV.

<Control Unit>

Figure 6:
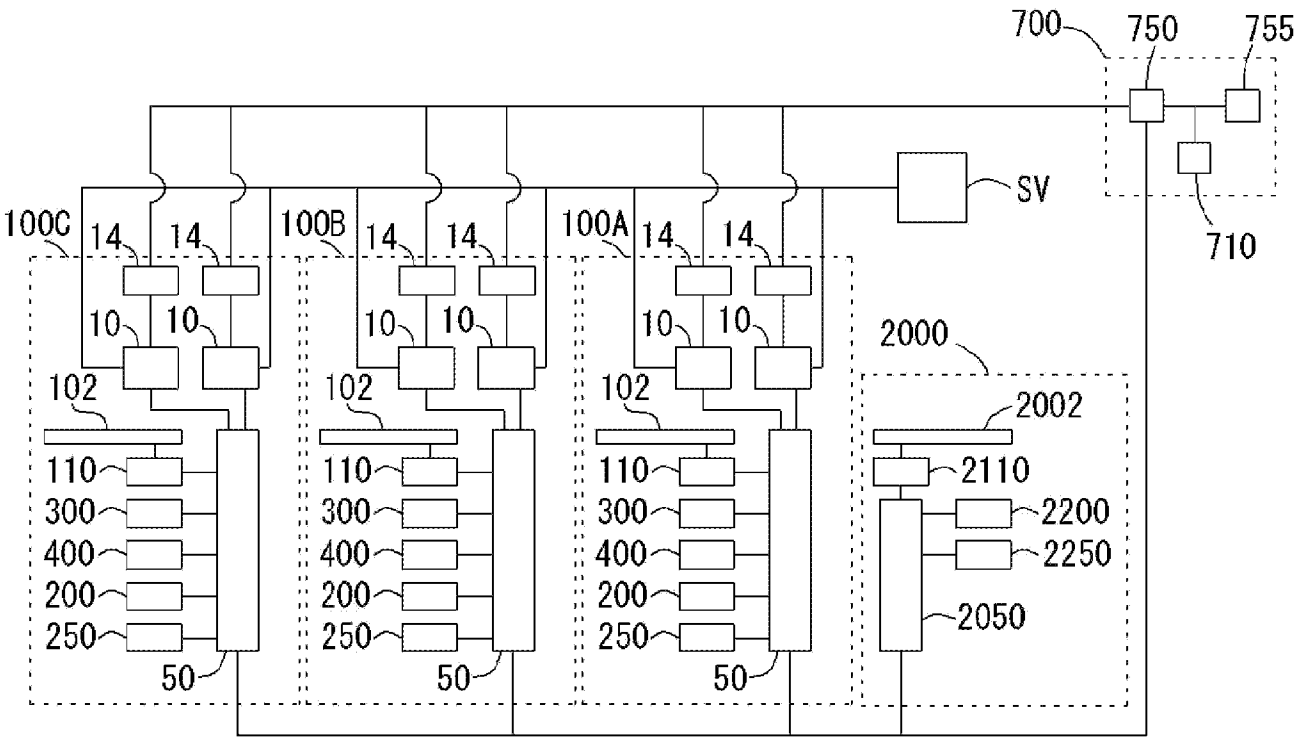
FIG. 6 is a control block diagram of an eyeglass lens processing system.

FIG. 6 is a control block diagram of the eyeglass lens processing system 1000. The RCL unit 100 includes the individual control unit 50. The individual control unit 50 is connected to the processing device 10; the drive unit 110 of the conveyer line 102; the stopper unit 200; the individual identifier reader 250; the tray elevation unit 300; and the robot 400, and sends a control signal thereto for operation.

The RCL units 100 having the reference numerals 100A, 100B and 100C have the same configuration described above.

The individual control unit 50 of each of the RCL unit 100 is connected to the main control unit 2050 of the distribution unit 2000. The distribution unit 2000 includes the stopper unit 2200 that has the same configuration as that of the stopper unit 200 disposed upstream of the conveyer line. The distribution unit 2000 includes the main identifier reader 250 that reads the bar code BC affixed to the tray TR. A drive unit 2110 of a conveyer line 2002, the stopper unit 2200 and the main identifier reader 2250 are connected to the main control unit 2050.

Each of the processing devices 10 is connected to the server SV. The server SV stores processing setting data for the lens LE, which corresponds to a work number. The work number for a pair of right and left lenses LE is assigned to the bar code BC. The bar code BC to which the work number is assigned is affixed to the tray TR. The bar code BC acquired by the individual control unit 50 is transmitted to the processing device 10. The processing device 10 acquires the processing setting data such as the lens shape from the server SV, and the processing setting data corresponds to the bar code BC. The processing device 10 processes peripheries of the lenses LE according to the processing setting data.

The control unit 750 of the terminal 700 is connected to the individual control unit 50, the main control unit 2050, the server SV, the memory 755 of the terminal 700, the memory 14 of the processing device 10 and the like.

<Flow of Method for Processing Periphery of Eyeglass Lens>

Figure 7:
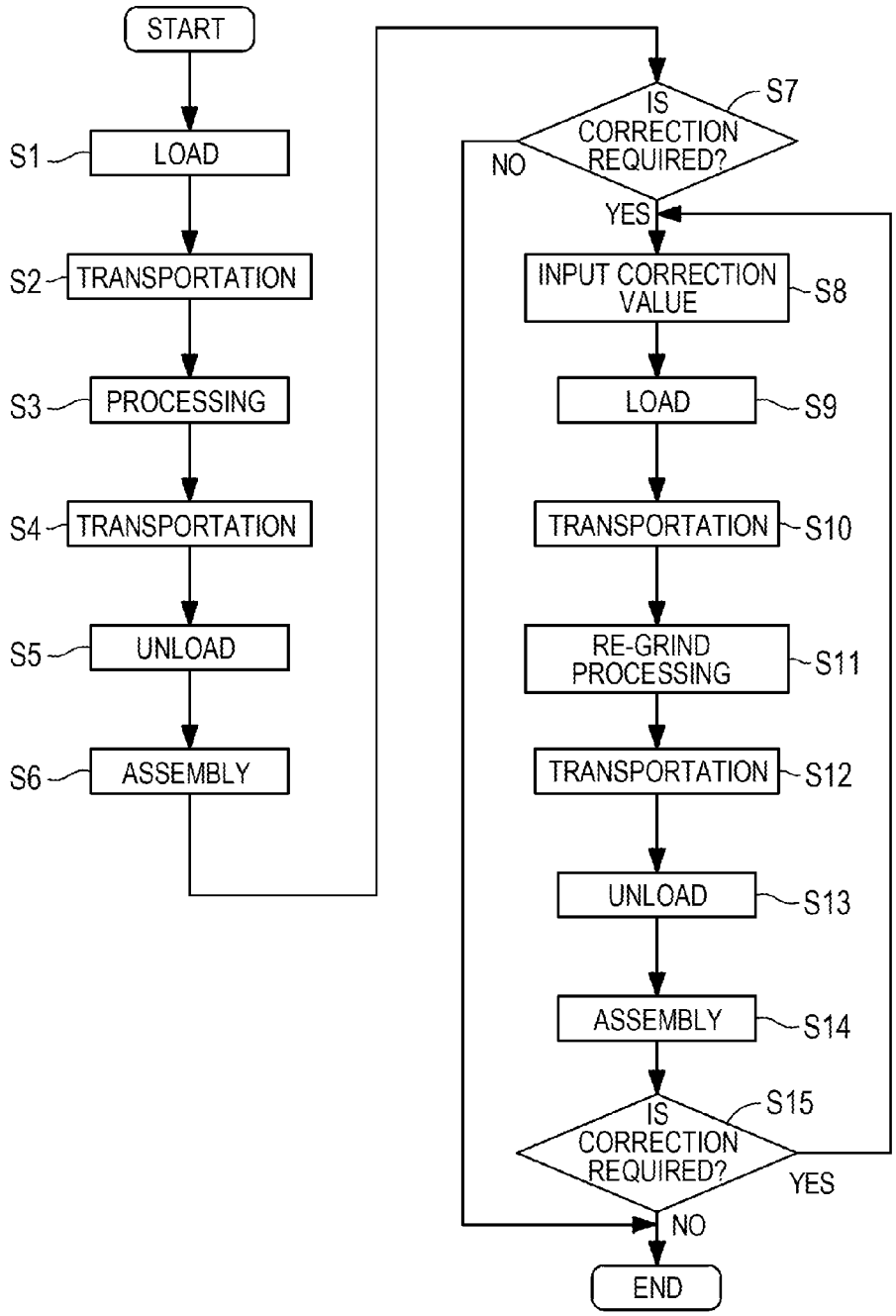
FIG. 7 is a flow chart illustrating a flow of a method for manufacturing eyeglasses.

The following describes a flow of a method for processing a periphery of an eyeglass lens using the eyeglass lens processing system 1000 of the embodiment. FIG. 7 is a flow chart illustrating the eyeglass lens processing method.

(S1—Load)

First, an operator loads a plurality of the trays TR containing the lenses LE onto the carry-in conveyer line 3000A.

(S2—Transportation)

The identifier such as the bar code BC is affixed to the tray TR, and it is possible to read the work number using the bar code reader such as the individual identifier reader 250 and the main identifier reader 2250. The plurality of loaded trays TR are transported by the transportation robot 500. The work number is read by the individual identifier reader 250 and the main identifier reader 2250, and the transportation robot 500 transports the tray to each of the processing devices 10. The transportation robot 500 unloads the lens LE from the transported tray TR, and attaches the lens LE to the processing device 10.

(S3—Processing)

The processing device 10 sends the work number read from the bar code BC to the server SV, and unloads processing setting data for the lens LE (before the lens LE is corrected) from the server SV as the first processing information. First, the processing device 10 measures the shape of the set lens LE. Subsequently, the processing device 10 processes the lens LE based on the processing setting data uploaded from the server SV. The processing device 10 stores the lens shape measurement data and the processing setting data used for processing the lens in the memory 14.

(S4—Transportation)

When the processing is completed, the transportation robot 500 unloads the lens LE from the processing device 10 and sets the lens LE on the tray TR. The transportation robot 500 transports the tray TR to the discharge conveyer line 3000B.

(S5—Unload)

The operator unloads the plurality of trays TR collected at a carry-out port, and transports the trays TR to an assembly location AS.

(S6—Assembly)

An assembly operator attaches the lens LE to a frame that is determined for each of the work numbers.

(S7—Correction Necessity Determination)

The assembly operator determines whether it is necessary to correct (re-grind processing) the lens LE based on a state where the lens LE and the frame are assembled together. When the lens LE is not smoothly attached to the frame, the lens LE is corrected (re-grind processing). When the lens LE is smoothly attached to the frame without any problem, the processing device 10 finishes the processing without performing the correction at step S8.

(S8—Correction Value Input)

The lens LE is processed for the correction (re-grind processing). First, the assembly operator inputs the work number read by the identifier reader or the like into the terminal 700, and figures which one of the processing device 10 has processed the lens LE. The processing setting data is read from the processing device 10. The assembly operator inputs correction data for the re-grind processing into the terminal 700 based on the processing setting data for the lens LE. The processing setting data (before the processing setting data is corrected) is corrected by the set input correction data, and processing setting data (after the processing setting data is corrected) is used as the second processing information. When the corrected processing setting data is stored in the memory 755, the terminal 700 transmits the processing setting data for the re-grind processing to the processing device 10 that has processed (regularly processed) the lens LE. The processing device 10 stores the processing setting data in the memory 14. At the same time, the assembly operator instructs the transportation robot 500 to transport the lens LE to the processing device 10 that stores (regularly processed) the non-corrected processing setting data. The terminal 700 may delete the non-corrected processing setting data at the time when the corrected processing setting data is transmitted to the processing device 10.

(S9—Load)

The assembly operator resets the lens LE that requires the re-grinding on the tray TR, and loads the tray TR on the carry-in conveyer line 3000A. At this time, the plurality of other trays TR may be loaded.

(S10—Transportation)

The transportation robot 500 reads the work number for the loaded tray TR, and transports the loaded tray TR to the processing device 10 that is used in the previous processing. At this time, until the designated processing device 10 finishes a processing of the lens that is underway, the transportation robot 500 does not upload the tray TR on the processing device 10. When the processing that is underway is finished, the transportation robot 500 starts transporting the tray TR. When the transportation of the tray TR is completed, the transportation robot 500 unloads the lens LE from the tray TR, and attaches the lens LE to the processing device 10. The transportation robot 500 notifies the processing device 10 of the work number.

(S11—Re-Grind Processing)

The processing device 10 confirms whether the correction data for the re-grinding is stored in the memory 14 based on the work number. When there is no the correction data stored in the memory 14, the processing device 10 retrieves and reads the processing setting data from the server SV. When there is the correction data stored in the memory 14, the processing device 10 processes the lens as being set without measuring the lens.

(S12—Transportation)

When the re-grind processing is finished, the transportation robot 500 unloads the lens LE from the processing device 10, and sets the lens LE on the tray TR. The transportation robot 500 transports the tray TR to the discharge conveyer line 3000B.

(S13—Unload)

The operator unloads the tray that is transported to the discharge conveyer line 3000B, and transports the tray to the assembly location AS.

(S14—Assembly)

The assembly operator attaches the re-grinded lens to the frame that is determined for each of the work numbers.

(S15—Correction Necessity Determination)

When it is determined that additional correction (re-grind processing) is necessary after assembly is performed, the operator returns to step S8 to correct the processing setting data. When the lens LE is smoothly assembled into the frame, the operator finishes the processing without correcting the processing setting data.

According to the processing method and the processing system, it is possible to give instructions for the re-grind processing and the like to the plurality of processing devices 10 using the terminal 700 through which correction data for correcting the preset processing setting data can be set for each of the processing devices. For this reason, it is not necessary to place a person for each one of the processing devices 10. That is, it is possible to manage the plurality of processing devices 10 with a small number of persons. A plurality of terminals 700 may be provided.

In the processing device, the processing device 10 stores measurement data and processing setting data for the plurality of lenses LE. Accordingly, after the plurality of lenses LE are processed, it is possible to read only processing setting data for the lens that requires the re-grind processing and to perform a setting for correction. That is, it is not necessary to confirm whether the re-grind processing is required whenever one of the lenses LE is processed. After the plurality of lenses LE are processed, it is possible to collectively confirm whether the re-grind processing is required, and to perform a processing. Accordingly, efficiency in manufacturing eyeglasses improves.

The processing device 10 can distinguish regular processing setting data from correction data for the re-grinding.

When the processing device 10 uploads the processing setting data, the processing device 10 uploads the correction data for the re-grinding in preference. Accordingly, an operator does not need to input into the processing device 10 whether the processing of lens LE is the re-grind processing or the regular processing. Accordingly, an operator does not need to stand by the processing device 10 in order to input an instruction into the processing device 10.

<Operation and Control of System>

An operation of the eyeglass lens processing system 1000 will be described. The control unit (for example, the individual control unit 50) that controls the processing device 10 includes a processor (for example, a CPU) that takes charge of various control processes; and a memory medium (for example, the memory 14) that stores a processing device control program. The processor executes the following processes according to the processing device control program.

The control unit 750 of the terminal 700 includes a processor (for example, a CPU) that executes various control processes; and a memory medium (for example, the memory 755) that stores the eyeglass lens processing program. The processor executes the following processes according to the eyeglass lens processing program.

First, an operation for a regular processing will be described. First, an operator sequentially mounts the tray TR containing the non-processed lenses LE on the carry-in conveyer line 3000A. The tray TR moves to the conveyer line 2002 of the distribution unit 2000. The main control unit 2050 controls the stopper unit 2200 to temporarily stop the movement of the tray TR, and the main identifier reader 2250 reads the bar code BC of the tray TR.

Herein, the number (the example in FIG. 1 illustrates three RCL units 100A, 100B and 100C) of RCL unit 100 that is connected downstream of the main control unit 2050 and the number (that is, the number of tray elevation unit 300 of each of the RCL units 100) of tray TR that is acceptable to each of the RCL units 100 are registered in the memory of the main control unit 2050. When the tray elevation unit 300 does not have the tray TR at a waiting position, and can accept (can carry in) a new tray TR, the control unit 50 of the RCL unit 100 transmits to the main control unit 2050 a demand signal that demands the tray TR. When the main control unit 2050 has the demand signal for the tray TR input from the control unit 50 of each of the RCL units 100, the main control unit 2050 determines which one of the RCL units 100 is a destination to which the tray TR having the bar code read by the main identifier reader 2250 is transported, and then transmits a signal of the read bar code BC to the control unit 50 of the RCL unit 100 that is the determined transportation destination.

At an initial stage, each of the RCL units 100 is in a state where the tray elevation unit 300 can move the tray TR to each of waiting positions. Each of the control units 50 sends demand signals to the main control unit 2050, and the number of sent demand signals is equal to the number of tray elevation units 300 of the RCL unit 100 to which the control unit 50 belongs. The main control unit 2050 communicates with each of the control units 50, and determines the RCL unit 100 to which the tray TR on the carry-in conveyer line 3000A is transported based on the demand signals. Alternatively, the main control unit 2050 may determine which one of the processing devices 10 is used to process the lens on the tray on the carry-in conveyer line 3000A. The main control unit 2050 transmits to the control unit 50 of each of the RCL units 100 a signal of the bar code BC that is affixed to the tray TR and is identification information. For example, the main control unit 2050 determines a transportation destination of the RCL units 100 in such a manner that the tray TR is transported in sequence from the most-downstream RCL unit 100C. That is, the main control unit 2050 determines to distribute a first tray TR to the RCL unit 100C, and transmits to the control unit 50 of the unit 100C a signal of the bar code BC read by the reader 2250. Thereafter, the main control unit 2050 releases the tray TR from the stopper unit 2200, and supplies the tray TR to the downstream RCL unit 100A. Subsequently, the control unit 2050 retains the tray TR using the stopper unit 2200 to read the bar code BC of a second tray TR.

In each of the RCL units 100, the reader 250 reads the bar code BC that is identification information of the tray TR which is transported from the upper area. When the read identification information coincides with the sent identification information, the control unit 50 moves the tray TR to a waiting position using the tray elevation unit 300. In contrast, when the read identification information does not coincide with the sent identification information, the control unit 50 moves the tray TR to the downstream RCL unit 100.

When the tray TR mounted on the tray elevation unit 300 is positioned at a predetermined waiting position, the control unit 50 of the RCL unit 100C controls the robot 400 to move one of a right and a left lenses LE in the tray TR to the downstream processing device 10. Thereafter, the control unit 50 sends a processing command signal and a work number for the bar code BC to the processing device 10, and the processing device 10 starts processing the lens LE. The processing device 10 sends the work number for the bar code BC to the server SV, and demands processing setting data from the server SV. The server SV transmits the processing setting data corresponding to the work number to the processing device 10 that is a requestor. Accordingly, a processing of the lens LE is performed based on a predetermined processing condition that corresponds to the work number. After a processing compensation is calculated, the processing device 10 measures the lens shape using the lens shape measurement unit 13 (refer to JP-A-5-212661 for the processing compensation calculation, a configuration and an operation of measurement of the lens shape measurement unit 13), and calculates a bevel based on the acquired lens shape (edge thickness) information. The processing device 10 processes a periphery of the lens LE by controlling a relative movement between the lens LE and the lens processing unit 12. When the processing of the lens LE is completed, the processing device 10 stores the fact that the lens LE for the work number is processed, and the processing setting data used in the processing in the memory 14 in such a manner that the processing setting data can be used when the re-grind processing is performed.

The main control unit 2050 receives a demand signal from each of the control units 50, and the main control unit 2050 sequentially determines destinations to which the trays TR are distributed, which are transported to the conveyer line 2002 of the distribution unit 2000. When the tray TR is not distributed to its own RCL unit 100, the control unit 50 of each of the RCL units 100A, 100B and 100C does not operate the tray elevation unit 300, and passes the tray TR in such a manner that the tray TR is sent to the downstream conveyer line 102 or the discharge conveyer line 3000B. When the distributed tray TR is transported to its own RCL unit 100, the control unit 50 determines the tray elevation unit 300 that can move the tray TR to a waiting position, and controls the tray elevation unit 300 to separate the tray TR from the conveyer line 102. The transportation robot is referred to in JP-A-2012-183633.

When the processing device 10 processes the pair of right and left lenses LE on the tray TR at the waiting position, the tray elevation unit 300 moves the tray TR downward, and mounts the tray TR on the belt 104 of the conveyer line 102. Accordingly, the tray TR is transported to the downstream discharge conveyer line 3000B.

When the tray elevation unit 300 moves to the lowest retraction position, the control unit 50 sends to the main control unit 2050 a demand signal indicating a readiness that the next tray TR can be accepted to the waiting position. When the main control unit 2050 receives the demand signal of acceptance of the tray TR from the control unit 50 of each of the units 100, the main control unit 2050 sequentially determines destinations to which the trays TR are distributed, and the transportation of the trays TR are stopped by the stopper unit 2200. The main control unit 2050 releases the stop caused by the stopper unit 2200, and supplies the tray TR to the most-upstream conveyer line 102. When the main control unit 2050 does not receive the demand signal from each of the control units 50, the transportation of the trays TR is stopped by the stopper unit 2200, and the trays TR wait on the conveyer line 2002 of the distribution unit 2000 and the carry-in conveyer line 3000A.

An operator transports to the assembly location AS the tray TR that is transported to the discharge conveyer line 3000B. In the assembly location AS, the processed lens LE is put into an eyeglass frame for confirmation of the size. In the eyeglass lens processing system 1000, it is possible to process other lenses LE without stopping the processing device 10 during the confirmation work.

While the processing device 10 processes other lenses LE, an assembly operator confirms the size of the lens LE that is previously processed. The assembly operator unloads the lens LE from the tray TR, and puts the lens LE into an eyeglass frame to confirm the size thereof. When the size of the lens disagrees with that of the frame, the assembly operator acquires the amount of correction that is necessary for the re-grind processing.

A re-grind processing method will be described. The following example illustrates a case where the re-grind processing is performed on the lens LE processed for a work number M by a processing device 10C. The lens LE for the work number M is regularly processed by the processing device 10C disposed upstream in the RCL unit 100B, and is transported to the assembly location AS. An assembly operator puts the lens LE for the work number M into an eyeglass frame to confirm the size of the lens. At this time, the size of the lens LE for the work number M disagrees with that of the frame. The assembly operator determines the amount of correction that is necessary for the re-grind processing of the lens LE for the work number M.

When the re-grind processing is performed, the operator inputs the work number into the terminal. The work number may be written on the tray or the like. The operator may read the bar code BC using a portable identifier reader (not illustrated).

Figure 8A:
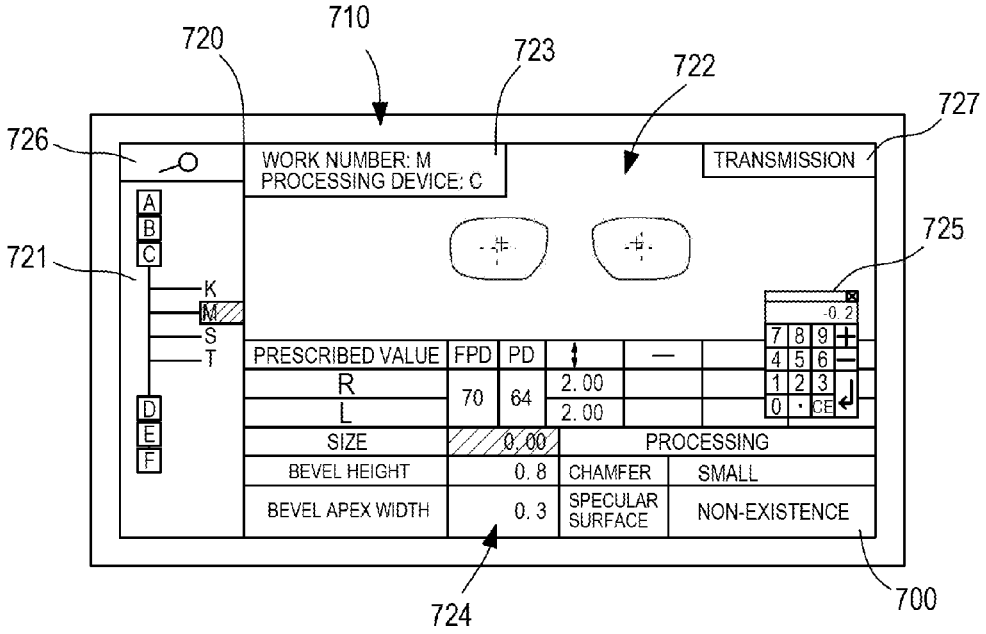
FIGS. 8A and 8B are views describing a screen display of a terminal when a correction is input.
Figure 8B:
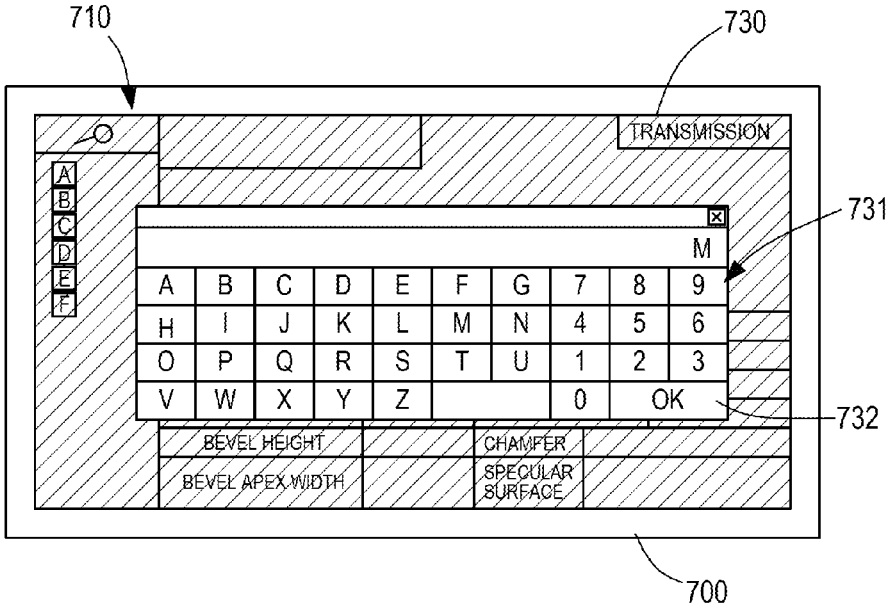

FIGS. 8A and 8B illustrate examples of display screens of the terminal 700. FIG. 8A illustrates an edit screen 720 for acquiring processing setting data (equivalent to the second processing information) for the re-grind processing. FIG. 8B illustrates an example of a retrieval screen 730 for retrieving processing setting data for the lens LE with a work number.

The edit screen 720 displays the followings: a display unit 721 that displays a memory location for initial processing setting data; a layout display unit 722 that displays a layout of the lens LE; a display unit 723 that displays a work number and identification information (for example, A to F) of the processing device 10 which processes the lens LE for the work number; a data display unit 724 that displays processing setting data for the lens LE and like; a numeral keypad screen 725 for inputting numerical values; a retrieval button 726 that displays the retrieval screen 730; and the like. The retrieval screen 730 displays a key board screen 731 for inputting the work number, a determination button 732 and the like. The terminal 700 can retrieve and read the processing setting data from the processing device 10 connected thereto based on the work number.

An assembly operator touches the retrieval button 726 displayed on the edit screen 720 to display the retrieval screen 730. The assembly operator touches the key board screen 731 displayed on the retrieval screen 730 to input the work number M and to touch the determination button 732.

When the determination button 732 is touched, the terminal 700 retrieves processing setting data for the input work number M from among the plurality of processing devices 10. The terminal 700 locates and reads the processing setting data (as the first processing information) for the work number M from the memory 14 of the processing device 10C. The read processing setting data may be or may not be stored in the memory 755.

The retrieval screen 730 is hidden, and the edit screen 720 is displayed again. The terminal 700 displays the layout or numerical value information of the lens LE on the edit screen 720 based on the processing setting data for the read work number M. The terminal 700 identifies the processing device 10 from which the processing setting data is read, and displays the identification information (for example, A to F) on the display units 721 and 723. Because of the display, it is possible to confirm that the processing setting data for the work number M is read from the processing device 10C. The identification information (for example, A to F) together with the processing setting data may be stored in the memory 755.

The assembly operator inputs a correction value based on the layout or the numerical values displayed on the edit screen 720. A correction value input method varies depending on a processing method or the like. The following example describes a case where the size of the lens LE is changed.

In order to change the size, the assembly operator touches a numerical value displayed in an entry of the size from among numerical values displayed on the data display unit 724. The numeral keypad screen 731 is displayed. The assembly operator inputs the correction data by manipulating the ten keys. For example, the assembly operator may touch a numerical value for an entry that requires correction, and input the correction data by manipulating the numeral keypad screen 731. Accordingly, the correction data is set, and processing setting data as the second processing information is acquired using the correction data. For example, in the terminal 700, after the correction data is set, the processing setting data is used as the second processing information for the re-grind processing.

As such, the terminal can retrieve and correct initial processing setting data from among all the processing devices 10 connected thereto.

Thereafter, when a transmission button 727 is touched, the terminal 700 transmits the processing setting data for the re-grind processing to the processing device 10C that performs the regular processing, and the processing device 10C stores the processing setting data corrected with the correction data in the memory 14. At the same time, the terminal 700 instructs the distribution unit 2000 to transport the tray TR for the work number M to the processing device 10C.

The assembly operator puts the processed lens into an eyeglass frame in a sequence where the processed lens is transported to the assembly location AS, and sequentially confirms the size of the lens. When the size of the lens disagree with that of the frame, similarly to in the case described above, the assembly operator inputs a size correction value for the re-grind processing into the terminal 700. The assembly operator repeatedly confirms the size and inputs the size correction value. Even during this period of time, the transportation robot 500 sequentially transports the trays TR loaded by the operator. The processing device 10 sequentially processes the transported lenses LE.

When the assembly operator finishes inputting the amount of size correction for the lens LE, the assembly operator returns the lens LE to the original tray TR, and transports the original tray TR to the carry-in conveyer line 3000A again. On the carry-in conveyer line 3000A, the tray TR containing the non-processed lens LE coexists with the tray TR containing the processed lens LE. The tray TR is transported to the distribution unit 2000 from the carry-in conveyer line 3000A, and is distributed to each of the processing devices 10.

The terminal 700 instructs the distribution unit 2000 to distribute the processed lens LE, which requires the re-grind processing, to the same processing device 10 that performs the regular processing. Accordingly, when the main identifier reader 2250 reads the work number M of the tray TR, the main control unit 2050 transmits the work number M to the control unit 50 of the RCL unit 100B, and instructs the control unit 50 to distribute the tray TR to the processing device 10C. Thereafter, the main control unit 2050 releases the tray TR from the stopper unit 2200, and supplies the tray TR to the downstream RCL unit 100A.

The RCL unit 100A operates the stopper unit 200, and the individual identifier reader 250 reads the work number M of the tray TR. Since the distributed tray TR is not the tray TR that the main control unit 2050 intends to distribute to its own RCL unit 100, the control unit 50 of the RCL unit 100A releases the stopper unit 200, and transports the tray TR to the RCL unit 100B.

Subsequently, the RCL unit 100B operates the stopper unit 200 in order for the individual identifier reader 250 to read the bar code BC. Since the control unit 50 is instructed to distribute the tray TR of the work number M to the processing device 10C, the control unit 50 releases the stopper unit 200, and a first and a second tray elevation unit 300 from an upstream side moves the tray TR of the work number M upward to a waiting position. At this time, when there is no empty tray elevation unit 300 that corresponds to the processing device 10C, the control unit 50 operates the stopper unit 200 in order for the tray TR waiting until the empty tray elevation unit 300 is available.

When the tray elevation unit 300 moves the tray TR of the work number M upward to a waiting position, the control unit 50 operates the robot 400. The robot 400 moves the processed lens LE in the tray TR to the upstream processing device 10C. Thereafter, the control unit 50 sends a processing command signal and the work number M of the bar code BC to the processing device 10C, and the processing device 10C starts processing the lens LE. When the processing device 10C receives the work number M, the processing device 10 retrieves whether the re-grind data is stored in a memory area of the memory 14 for the work number M. The correction data for the re-grinding, which is previously input through the terminal 700 by the assembly operator and includes the size correction value and the like, is stored in the memory area for the work number M. When the processing device 10C detects the correction data, the processing device 10C starts the re-grind processing based on the correction data stored in the memory 14 without demanding the processing setting data from the server SV and measuring the lens. Accordingly, When the processing of the lens LE is completed, the processing device 10C stores the fact that the lens LE for the work number M is re-grind processed, and the processing data used in the processing in the memory 14 in such a manner that the processing data can be used when the re-grind processing is performed again.

While the lens LE is being processed, the assembly operator sequentially puts the lens LE into an eyeglass frame to confirm the lens size.

When the re-grind processing for the work number M is completed, similarly to when the regular processing is finished, the tray TR is transported to the discharge conveyer line 3000B. On the discharge conveyer line 3000B, the tray TR containing the regularly processed lens LE coexists with the tray TR containing the re-grind processed lens LE. When the plurality of trays TR accumulate on the discharge conveyer line 3000B, the operator transports the accumulated trays TR to the assembly location AS. The assembly operator takes out the lens LE in the transported tray TR, and puts the lens LE into an eyeglass frame to confirm the size.

The re-grind processing of the lens LE for the work number M is performed, and the assembly operator puts the lens LE into the frame to confirm the size again. When the size of the lens LE agrees with that of the eyeglass frame by the re-grind processing, the lens LE is shrouded by the frame, and the assembly step is completed. When the size confirmation indicates that the re-grind processing is necessary again, the procedures are repeated, and the lens LE is processed to settle into the frame.

The description illustrates the case where the size of the lens LE is changed. However, even in a case where the size of a hole or a groove processed in the lens LE is changed, the embodiment is effective. The embodiment is not limited to change in size, and the embodiment has the same effect on various processing correction such as design change.

The eyeglass lens processing system of the embodiment is applicable to even a case where there is no transportation robot installed and one processing device 10 is used. In this case, an operator instead of the transportation robot attaches the lens LE to the processing device 10.

<Modification Example>

The embodiment illustrates an example in which the eyeglass lens processing system of the present invention is used in the re-grind processing, but the present invention is not limited to the embodiment. The eyeglass lens processing system is applicable to various processing. For example, the eyeglass lens processing system is applicable to a guide mode (a compulsion mode).

Figure 9:
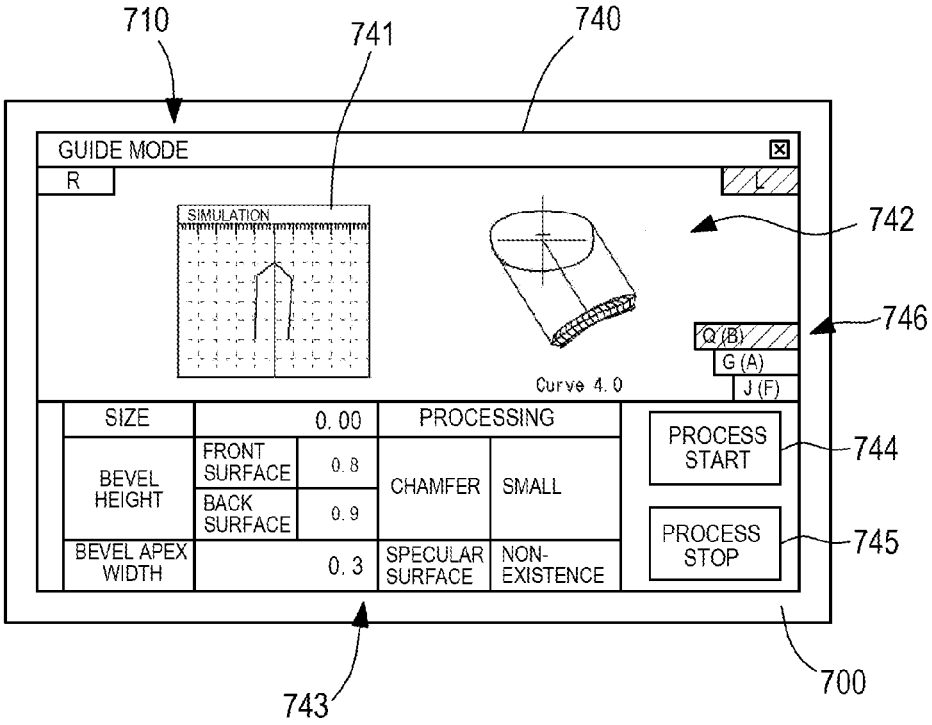
FIG. 9 is a view illustrating an example of a screen display of the terminal when a guide mode is performed.

The guide mode will be described. FIG. 9 is a view describing a display screen of the terminal 700 during the guide mode. For example, in the guide mode, lens shape data (simulation data) after a lens is processed is calculated, and processing setting data as the first processing information can be corrected based on the calculated simulation data. In more detail, in the guide mode, a lens is mounted on the processing device 10, and an operation of the processing device 10 starts. When the operation of the processing device 10 starts, the lens shape measurement unit 13 provided in the processing device 10 measures the shape of the lens. The individual control unit 50 calculates lens shape data (simulation data) based on the measured lens shape data after the lens is processed. The calculated simulation data is transmitted to the terminal 700. While an operator confirms the simulation data displayed on the terminal 700, the operator can input correction data. Processing setting data as the second processing information is acquired using the correction data. For example, in the terminal 700, after the correction data is set, the processing setting data is used as the second processing information for the guide mode.

For example, there are bevel locus data or groove locus data as the simulation data. For example, in a case where the simulation data is the bevel locus data, the individual control unit 50 obtains the bevel locus data based on the measured lens shape data. When the bevel locus data is calculated, the bevel locus data is transported to the terminal 700. For example, a guide mode screen 740 displayed on the terminal 700 displays the following screens: a display screen 741 on which a cross-sectional figure, an apex position and the like of a bevel are displayed; a display screen 742 on which a bevel curve value, a lens shape figure and the like are displayed; a display screen 743 on which processing setting data and the like are displayed; and the like. An operator can correct the apex position of the bevel, the bevel curve position and the like on the screen of the terminal 700.

The following describes a configuration in which it is identified whether the guide mode for each lens is performed. For example, for each work number, the server SV stores processing setting data for the lens LE and guide mode identification information for identifying whether the guide mode is performed when the lens is processed. The work number for the lens LE is assigned to the bar code BC. The bar code BC to which the work number is assigned is affixed to the tray TR. The identifier is not limited to the bar code BC, and various identifiers are used.

The bar code BC acquired by the identifier reader is transmitted to the individual control unit 50 of the processing device 10. The individual control unit 50 acquires from the server SV the processing setting data such as a lens shape which corresponds to the bar code BC. The individual control unit 50 acquires from the server SV the guide mode identification information for identifying whether the guide mode is performed.

An operation of the guide mode under execution will be described. The individual control unit 50 controls the processing device 10 to start an operation for processing the periphery of the lens LE according to the processing setting data. The processing device 10 executes the guide mode based on the guide mode identification information. In the lens of which the execution of the guide mode is set, after a lens shape is measured, the individual control unit 50 calculates simulation data. The processing device 10 temporarily stops the processing. The individual control unit 50 transmits the calculated simulation data to the terminal 700.

When the terminal 700 receives the simulation data, the terminal 700 displays the simulation data and the processing setting data on the guide mode screen 740 of the terminal 700. The terminal 700 may calculate the simulation data based on the lens measurement data, the processing setting data and the like acquired from the processing device 10. While the operator confirms the simulation data displayed on the terminal 700, the operator corrects various parameters of the processing setting data.

When the operator completes the correction of the processing setting data, for example when the operator touches a process start button 744 on the screen, the terminal 700 transmits the corrected data to the individual control unit 50 of the processing device 10 that is temporarily at stop. When the individual control unit 50 receives the correction data, the processing device 10 starts processing the lens LE based on the correction data. For example, when the correction is not smoothly performed, the operator touches the process start button 745 on the screen. The terminal 700 transmits a processing stop signal to the individual control unit 50 of the processing device 10 that is temporarily at stop. When the individual control unit 50 receives the signal, the individual control unit 50 returns the lens LE to the original tray TR without performing the processing, and the transportation robot 500 transports the tray TR to the discharge conveyer line 3000B.

As such, the processing setting data can be corrected by simulating the shape of the lens after the lens is processed and thus, it is possible to process the lens as desired. For this reason, it is possible to reduce efforts of adjusting the lens again after the lens is processed. Since it is possible to collectively manage the control of the guide mode executed by each of the processing devices 10, it is not necessary to place an operator for each of the processing devices, and it is possible to efficiently process the lens.

In the guide mode, when the terminal 700 receives the simulation data from one or the plurality of processing devices 10, the display unit 746 may display the received work number for the lens LE and the received identification information (for example, A to F) of the processing device 10 to which the lens LE is set. When a plurality of items of the received simulation data is displayed on the guide mode screen 740, the sequence of the display may be a sequence in which the simulation data is received. The operator may select the lens LE of which the simulation data is displayed on the guide mode screen 740 by touching the work number and the identification information of the processing device 10 displayed on the display unit 746.

The eyeglass lens processing system of the present invention is applicable to even a hole processing for making a hole, a step processing for making a step to the lens, or the like. For example, a hole position or a hole size of the lens is set using the terminal 700, and the set processing data is transmitted to the processing device 10. The hole processing is performed based on the transmitted hole processing data.

The simulation is not limited to the simulation performed by the individual control unit 50. For example, the simulation may be performed by the main control unit 2050, the control unit 750 of the terminal 700 or the like.

The embodiment illustrates various configurations in relation to a data transmission method between various control units such as the terminal 700, the individual control unit 50, the distribution unit 2000, the server SV, the main control unit 2050, and the like. For example, the embodiment illustrates the configuration in which the terminal 700 transmits the correction data to the individual control unit 50 and the distribution unit 2000, but the present invention is not limited to the configuration. The embodiment may have a configuration in which the terminal 700 transmits the correction data to the individual control unit 50 through various networks. In more detail, the embodiment may have a configuration in which the correction data is transmitted to the server SV, and the server SV transmits the correction data to the individual control unit 50 or the distribution unit 2000. As such, the terminal 700 is accessible to each of the processing devices.

When the processing device 10 has a plurality of the lens processing unit (processing unit) 12, and the re-grind processing is performed, the re-grind processing may be performed by the same processing unit 12 as the lens processing unit 12 that is used in the regular processing. Accordingly, it is possible to prevent processing variation caused by deviations between the processing units 12. It is possible to use the different processing units 12 for each of the regular processing and the re-grind processing.

The embodiment illustrates the configuration in which various control units such as the terminal 700, the individual control unit 50, the distribution unit 2000, the server SV, the main control unit 2050 are independently provided, but the present invention is not limited to the configuration. The eyeglass lens processing system may have a configuration in which a part of the control units can serve as each of the control units, or a configuration in which one control unit controls the entire system. For example, there may be a configuration in which the control unit of the terminal 700 can serves as that of the server SV or vice versa. In more detail, there may be a configuration in which the terminal 700 can serve as the server SV and vice versa, processing setting data is corrected through the server SV, and the correction data is transmitted to each of the processing devices 10. In the embodiment, the processing setting data is stored in the server SV and the processing device 10, but the present invention is not limited to the configuration, and the correction data may be stored in anywhere. For example, the present invention may have a configuration in which the processing setting data is stored in a memory medium external to the server SV and the processing device 10, and the memory medium exchanges the data with the server SV and the processing device 10 using communication means such as a wired or a wireless system. The present invention may have a configuration in which the processing setting data is stored in the memory 755 of the terminal 700. In this case, when the processing setting data is corrected, the terminal 700 corrects the processing setting data stored in the memory 775 thereof. Accordingly, it is not necessary for the terminal 700 to access the outside (the processing device 10, server SV or the like) thereof to acquire the processing setting data.

The embodiment has the configuration in which when the processing device 10 processes the lens LE, the lens shape measurement data and the processing setting data are stored in the memory 14 of the processing device 10, but the present invention is not limited to the configuration. For example, the lens shape measurement data and the processing setting data may be stored in the server SV.

In this case, it is preferred that the server SV identify the processing device 10 from which the data is acquired, and store the acquired data in a memory area independent for each of the processing devices 10. For example, data acquired from the processing device 10A is stored in a folder A, and data acquired from the processing device 10B is stored in a folder B. As such, the acquired data may be stored to be able to identify the processing device 10 from which the data is acquired. Accordingly, when the terminal 700 and the like access the server SV to acquire the processing setting data and the like, it is possible to identify the processing device 10 from which the data for the work number is acquired. Accordingly, the terminal 700 can determine the processing device 10 to which the lens LE required of the re-grind processing needs to be transported, and can give an instruction to the main control unit 2050.

As such, the trays TR may be distributed to each of the processing devices 10 based on items of the identification information (for example, A to F) that are stored in the memory media (for example, the memory 14, the server SV and the memory 755) of the eyeglass lens processing system 1000 to identify each of the processing devices 10. The present invention has the configuration in which the identification information is stored in the memory 755 of the terminal 700 and the memory 14 of the processing device 10, but the present invention is not limited to the configuration.

The embodiment has the configuration in which the eyeglass lens processing system 1000 includes the individual control unit 50 and the main control unit 2050, but the present invention is not limited to the configuration. The main control unit 2050 may function even as the individual control unit 50. The individual control unit 50 and the main control unit 2050 may be configured to integrate with the control unit 750 of the terminal 700. In this case, the control unit 750 can preferably control each of the devices (the processing device 10, the transportation robot 500 and the like).

For example, there may be a configuration in which an operation of the processing device 10 is controlled through the terminal 700. In more detail, there may be a configuration in which the processing device 10 can serve as the terminal 700 and vice versa, and on the processing device that serves as the terminal 700, various settings or operations are performed, and an operation of another processing device is controlled. Alternatively, an operation of the processing device may be controlled through the terminal 700. In this case, the control unit 750 of the terminal 700 can preferably transmit to the processing device 10 a drive control signal for controlling a drive of the processing device 10. As such, the terminal 700 can preferably transmit to the processing device 10 a signal, for example, a drive control signal in relation to data such as the processing setting data or the correction data for the re-grinding.

The embodiment has the configuration in which the operator operates to correct various parameters of the processing setting data, and to set the correction data for the re-grinding, but the present invention is not limited to the configuration. The present invention may have a configuration in which when the operator performs a setting for the re-processing, determined corrections of the various parameters are performed. For example, when there is a lens required of the re-grinding, the operator selects a re-processing (re-grinding) switch that is not illustrated on the terminal 700 and thus, a value of a predetermined entry is corrected by a predetermined amount.

In the embodiment, the transportation robot 500 transports the lens LE required of the re-grind processing to the processing device 10 that performs the regular processing. This is because when the lens LE is processed by the same processing device 10 as that used in the pre-processing (regular processing), processing variation caused by deviations between the processing devices 10 does not occur. When there are deviations between the processing devices 10, the lens LE is preferably re-grinded by the same processing device 10 as that used in the pre-processing (regular processing).

In a case where the lens LE required of the re-grind processing is set to a different processing device due to an erroneous operation of the transportation robot 500 or an operator's mistake, the server SV may not send the processing setting data to the processing device 10. Even though the processing device 10 tries to access the server SV to acquire the processing setting data, the server SV may limit the access of the processing device 10.

When the processing device 10 cannot receive or acquire the processing setting data from the server SV, the processing device 10 may stop the processing of the lens LE. When the processing is stopped, the individual control unit 50 may stop the operation of the processing device 10. The individual control unit 50 controls the robot 400 to unload the lens LE from the processing device 10, and to return the lens LE to the tray TR. The individual control unit 50 may control the RCL unit 100 to transport the tray TR to the carry-out unit 3000B. The operator may select the lens LE suitable for the processing based on the processing setting data, and replace the lens LE in the tray TR.

However, it is possible to perform the re-grind processing (post-processing) using the processing device 10 different from the processing device 10 that performs the regular processing (pre-processing). In this case, the operator preferably compensates for the correction data or the amount of drive of the lens processing unit 12 due to the deviation between the processing devices 10. The transportation robot 500 transports the tray TR to the processing device 10 different from the processing device 10 that performs the regular processing (pre-processing). The tray TR that contains the lens LE required of the re-grind processing is randomly distributed to each of the processing devices 10.

In the embodiment, the tray TR contains the pair of right and left lenses LE, and the right and the left lenses LE are alternately processed by the same processing device 10. However, the present invention is not limited to the configuration. The right and the left lenses LE may be separately transported, and can be processed by the different processing devices 10. For example, the right lens LE may be processed by the processing device 10A, and the left lens LE may be processed by a processing device 10D. Even in a case where it is necessary to perform the re-grind processing, similarly, the right lens LE may be processed by the processing device 10A, and the left lens LE may be processed by the processing device 10D.

In the embodiment, the assembly operator inputs the work number on the retrieval screen 730 displayed on the terminal 700, and retrieves the processing setting data from the plurality of processing devices 10. However, the present invention is not limited to the configuration. The operator may start retrieving the processing setting data for the read work number by reading an identifier provided on the tray TR or the like with an identifier reader that is connected to the terminal 700 and is not illustrated.

The embodiment is applicable to even a single eyeglass lens processing device. For example, the processing device 10 is provided with an external terminal device (for example, the terminal 700).

The external terminal device includes a setting unit that can set correction data for each of the processing devices to acquire the second processing information obtained by correcting the first processing information which is stored in a processing information memory unit (for example, the memory 755) and can be used by the processing device 10. That is, the external terminal device is used as the processing setting unit.

Furthermore, the external terminal device has an acquisition unit that can acquire the first processing information for each of the processing devices. For example, the control unit 750 of the terminal 700 is used as the acquisition unit and the setting unit. The acquisition unit acquires the first processing information from the processing information memory unit (for example, the server SV) that stores the first processing information which can be used by the processing device 10. Accordingly, for example, it is possible to arbitrarily change the first processing information.

Even though the processing setting unit is configured not to have the acquisition unit that acquires the first processing information, the configuration is acceptable as long as the correction data can be set for each of the processing units. For example, the correction data is set on the processing setting unit. Each of the processing devices may be configured to correct the first processing information based on the correction data, and to use the second processing information.

For example, the processing device 10 is set to sequentially process the right and the left eyeglass lenses for an eyeglass frame. The processing device 10 includes a control unit (for example, the control unit 750) that stores the first processing information for the eyeglass frame, which is already used by the processing device 10, in the processing information memory unit even after the processing device 10 moves to a step in which a right and a left eyeglass lenses for a next eyeglass frame are processed.

An eyeglass lens processing program is stored in the memory unit (for example, the memory 755) of the external terminal device. The program is executed by a processor of the external terminal device and thus, the external terminal device executes a setting step that sets the correction data to acquire the second processing information obtained by correcting the first processing information which is stored in the processing information memory unit (for example, the memory 755) which stores the first processing information useable by the processing device 10.

What is claimed is:

1. An eyeglass lens processing system comprising:

a plurality of processing devices including first and second processing devices, each of the first and second processing devices including a lens processing unit configured to grind an eyeglass lens and a processing control unit configured to control the lens processing unit;

a memory unit configured to store first processing information based on which the first processing device performs a first grind on the eyeglass lens; and a processing setting unit that includes a setting unit configured to set, for each of the first and second processing devices, correction data based on which the first processing information is to be corrected to acquire second processing information, wherein one of the first and second processing devices performs a second grind on the eyeglass lens based on the second processing information.

2. The eyeglass lens processing system according to claim 1, wherein the first processing information is used for processing a non-processed eyeglass lens, the second processing information is used for processing the eyeglass lens which has been ground based on the first processing information;

the one of the first and second processing devices performs the second grind on the eyeglass lens, which has been ground based on the first processing information based on the first processing information, based on the second processing information.

3. The eyeglass lens processing system according to claim 2, wherein the first and second processing devices are configured to sequentially grind a right eyeglass lens and a left eyeglass lens for an eyeglass frame based on the first processing information, the first processing information can be used by the plurality of processing devices, the memory unit keeps storing the first processing information even after the first processing device grinds the right eyeglass lens and the left eyeglass lens for the eyeglass frame based on the first processing information and the first processing device moves to a step in which a right and a left eyeglass lenses for a next eyeglass frame are ground.

4. The eyeglass lens processing system according to claim 2, wherein the first processing device acquires the second processing information, and performs the second grinding on the eyeglass lens, which is ground by the first processing device based on the first processing information, based on the second processing device.

5. The eyeglass lens processing system according to claim 2, further comprising:

a transportation device configured to transport to each of the first and second processing devices a container which contains the eyeglass lens; and a transportation control unit configured to determine one of the first and second processing devices in which the container containing the non-processed eyeglass lens is to be carried, and control the transportation device to transport the container to the determined one of the first and second processing device, wherein the transportation control unit includes a determination reception unit configured to receive a determination signal for determining one of the first and second processing device which is to perform the second grinding based on the second processing information, and wherein the transportation control unit is configured to control the transportation device to transport the container containing the ground eyeglass lens to the one of the first and second processing device that is to perform the second grinding based on a determination signal received by the determination reception unit.

6. The eyeglass lens processing system according to claim 5 further comprising:

a processing device memory unit configured to store processing device information for identifying the processing device by which the eyeglass lens has been ground; and a determination process unit configured to determine, based on the processing device information stored in the processing device memory unit, one of the first and second processing devices for performing the second grinding in such a manner that the second grinding is performed using the same processing device that has been performed the first grinding, wherein the determination process unit generates the determination signal based on the determination result, wherein the determination reception unit receives the determination signal from the determination process unit.

7. The eyeglass lens processing system according to claim 1, wherein the setting unit is configured to set the correction data before the first processing device performs the first grinding, and the one of the first and second processing devices performs the second grinding on the non ground eyeglass lens based on the second processing information.

8. The eyeglass lens processing system according to claim 1, wherein each of the processing devices includes a measurement unit configured to measure a shape of the eyeglass lens, the memory unit stores identification information for identifying whether the processing device executes a guide mode for each of the eyeglass lenses, each of the processing devices is configured to acquire the identification information from the memory unit, each of the processing devices includes a guide control unit configured to temporarily stop the processing unit after the measurement unit performs a measurement when the identification information is acquired, the processing setting unit includes a display control unit configured to simulate a shape of the lens ground based on the shape of the eyeglass lens measured by the lens shape measurement unit, and graphically display the simulation result on a display unit, the setting unit is configured to set the correction data after the simulation result is displayed on the display unit.

9. The eyeglass lens processing system according to claim 1, wherein the processing control unit is configured to obtain the second processing information based on the correction data set by the setting unit, and control the lens processing unit to perform the second grinding on the eyeglass lens based on the second processing information.

10. The eyeglass lens processing system according to claim 1, wherein the setting unit includes an instruction reception unit configured to receive an instruction from an operator, and a selection unit configured to select the first processing information for at least one eyeglass lens from a plurality of items of the first processing information stored in the memory unit based on the instruction received by the instruction reception unit, and the setting unit sets the correction data based on which the first processing information selected by the selection process unit is corrected to acquire the second processing information.

11. The eyeglass lens processing system according to claim 1, wherein the setting unit is provided at an external terminal device which is accessible to the plurality of processing devices.

12. The eyeglass lens processing system according to claim 11, wherein the setting unit includes an instruction reception unit configured to receive an instruction from an operator, and the setting unit sets the correction data based on the instruction received by the instruction reception unit.

13. The eyeglass lens processing system according to claim 11, wherein the external terminal device includes the memory unit which stores processing device information for identifying which processing device has ground the eyeglass lens.

14. The eyeglass lens processing system according to claim 13, wherein the setting unit includes a display control unit configured to display on a display unit processing device information for identifying which processing device has ground the eyeglass lens.

15. The eyeglass lens processing system according to claim 8, wherein the display control unit displays on the display unit a fact that the processing unit temporarily stops.

16. The eyeglass lens processing system according to claim 15, wherein when only one of the processing units temporarily stops, the display control unit automatically displays the simulation result on the display unit, and when a plurality of the processing units temporarily stop, the display control unit may sequentially display simulation results.

17. An eyeglass lens processing method for controlling an eyeglass lens processing system including a plurality of processing devices, the method comprising:

performing a first grinding on the eyeglass lens using one of the plurality of processing devices based on first processing information;

setting, for each of the plurality of processing devices, correction data based on which the first processing information which is stored in a memory is to be corrected to acquire second processing information;

acquiring the second processing information; and performing a second grinding on the eyeglass lens using any one of the plurality of processing devices based on the second processing information.

18. The eyeglass lens processing method according to claim 17 further comprising:

receiving an instruction from an operator; and setting the correction data based on the instruction received by the instruction reception unit.

19. An eyeglass lens processing system comprising:

a plurality of processing devices, each of which is configured to grind a plurality of eyeglass lenses based on first processing information and second processing information;

a host computer configured to store the first processing information which is selectively transmitted to one of the plurality of processing devices, and is used in a first processing in which a non-processed eyeglass lens is ground;

an external terminal that is remotely disposed from the processing device and the host computer, and is configured to access to the first processing information, the external terminal being configured to receive the first processing information and set correction data for performing a second processing in which the eyeglass lens which is processed based on the first processing information is further ground, and wherein the first processing information is corrected based on the correction data set by the external terminal, and wherein the one of the plurality of processing devices which has ground the eyeglass lens based on the first processing information grinds the eyeglass lens based on the second processing information.

* * * * *